US006325589B1

(12) United States Patent
Jang et al.

(10) Patent No.: US 6,325,589 B1
(45) Date of Patent: Dec. 4, 2001

(54) LOADER WITH A CONTROLLED VERTICAL PATH OF A WORKING IMPLEMENT

(75) Inventors: Moo Hwan Jang, Seoul; Seung Kuh Lee, Kyonggi-do; Nag In Kim, Daejon, all of (KR)

(73) Assignee: Daewoo Heavy Industries Ltd., Incheon (KR)

( * ) Notice: Subject to any disclaimer, the term of this patent is extended or adjusted under 35 U.S.C. 154(b) by 0 days.

(21) Appl. No.: 09/539,871

(22) Filed: Mar. 31, 2000

(30) Foreign Application Priority Data

Mar. 31, 1999 (KR) ..... 99-11195

(51) Int. Cl.[7] ..... B66C 23/00
(52) U.S. Cl. ..... 414/686; 414/685
(58) Field of Search ..... 414/685, 686, 414/680, 917, 697, 706

(56) References Cited

U.S. PATENT DOCUMENTS

| | | | | |
|---|---|---|---|---|
| 4,355,946 | * | 10/1982 | Wykhuis et al. | 414/707 |
| 5,169,278 | * | 12/1992 | Hoechst et al. | 414/685 |
| 5,518,358 | * | 5/1996 | Aschroft et al. | 414/685 |
| 5,609,464 | * | 3/1997 | Moffitt | 414/685 |

* cited by examiner

*Primary Examiner*—Donald W. Underwood
(74) *Attorney, Agent, or Firm*—Staas & Halsey, LLP

(57) ABSTRACT

A loader with a controlled vertical path of a working implement comprises a frame and a pair of laterally spaced lift booms disposed at opposite lateral sides of the frame for elevational movement between lowered and raised positions, each of the lift booms having a forward free end which carries a working implement and a rear proximal end articulately mounted to the frame. A pair of front control links are arranged on the opposite sides of the frame, each of the front control links having a first end pivotally attached to the frame at a first pivot point and a second end pivotally connected to the rear proximal end of the respective lift boom at a first connection point. Furthermore, a pair of rear control links are disposed rearward of the front control links and arranged on the opposite sides of the frame, each of the rear control links having a first end pivotally attached to the frame at a second pivot point positioned rearwardly and downwardly of the first pivot point and a second end pivotally connected to the rear proximal end of the respective lift boom at a second connection point positioned rearwardly and upwardly of the first connection point when the lift booms are in the lowered position. The elevational movement of the lift booms is caused by a pair of boom cylinders in such a manner that the working implement can move along a generally sinusoidal travel path.

13 Claims, 7 Drawing Sheets

LOADER WITH A CONTROLLED VERTICAL PATH OF A WORKING IMPLEMENT

FIELD OF THE INVENTION

The present invention is generally directed to a loader having a lift boom assembly mounted to a vehicle frame for raising up and lowering down a bucket or other working implements attached to a forward distal end of a lift boom. More specifically, the invention pertains to a loader whose lift boom assembly is so configured as to move the bucket along a controlled vertical path of travel with enhanced stability.

DESCRIPTION OF THE PRIOR ART

Use has heretofore been made of self-propelled loaders capable of, e.g., dumping such a load as bulk material into a container or truck. Typical examples of the loaders include a skid steer loader which is usually small in size but has an excellent maneuverability owing to its discretely driven wheels or caterpillars. Such loaders are provided with a lifter device which mounts a bucket or other working implements to a vehicle frame in an elevationally movable manner.

A prior art skid steer loader with a typical lift boom assembly is illustrated in FIG. 1. As shown, the skid steer loader includes a vehicle frame 10 having upright supports 12 positioned at the rear section of the frame 10. Pivotally attached to the upright supports 12 are a pair of laterally spaced lift booms 14 which have a working implement or tool, e.g., bucket 16, mounted between the forward free ends thereof. Vertical movement of the lift booms 14 and the bucket 16 relative to the frame 10 can be caused by means of double acting boom cylinders 18 arranged on opposite lateral sides of the frame 10. A bucket cylinder 20 is utilized in causing the swinging movement of the bucket 16 relative to the lift booms 14.

With the loader illustrated in FIG. 1, the bucket 16 has a tendency to move, responsive to the elevational movement of the lift booms 14 between lowered and raised positions, along a heavily curved vertical path of travel 22 forming a part of a circle whose center lies at the pivot point 24 of the respective lift boom 14. At about midheight point of the vertical travel path, the bucket 16 exhibits the greatest overhang OH, wherein the term "overhang" means the distance measured from the center axis of the front wheel 26 to a vertical plane on which the pivot axis of the bucket 16 lies, during the elevational movement of the bucket 16. The prior art loader shown and described above has a disadvantage in that it becomes highly unstable as the lift booms and the loaded bucket are raised up and lowered down, due to the fact that the overhang OH directly affecting the stability of the loader grows too great at the midheight of the vertical travel path of the bucket 16. Unstableness of the loader may lead to vehicle tipping in the worst circumstances.

In an effort to provide solution to the problem pointed out just above, U.S. Pat. No. 5,609,464 issued Mar. 11, 1997 to John M. Moffitt et al. discloses a lift boom assembly for a loader machine including a pair of laterally spaced interconnected lift arms having a tool mounted between forward ends thereof. Each lift arm includes a main lift link having upper and lower connecting portions at a rear end thereof. A second lift link is pivotally connected to the upper connecting portion of the main lift link and partially controls movement of the respective lift arm. The opposite end of each second lift link is pivotally connected to a frame of a machine on which the lift assembly is mounted. Movement of the lift arms is further controlled by a pair of control arms.

A lower end of each control arm is pivotally connected to the frame. When the boom assembly is in a lowered position relative to the frame, a second or upper end of each control arm extends upwardly and rearwardly from the lower end and is pivotally connected to the lower connecting portion of the respective main lift link. In response to vertical movement of the boom assembly between raised and lowered positions, each control arm swings forwardly and rearwardly of its true vertical position to alter the movement of the lift arms and such that the tool is elevationally moved along a generally linear vertical path. A pair of extendable and retractable drivers provide powered vertical movement to the lift assembly and the tool carried thereby relative to the frame.

According to the lift boom assembly taught in the 464 patent, there is no denying the fact that the tool or bucket attached to the forward ends of the lift arms can be moved along a generally linear vertical path of travel between the lowered and raised positions, thus significantly improving the overall stability and the load lifting capacity of the loader. The boom assembly is however disadvantageous in that it requires a pair of supports of substantial elevation for supporting itself high enough to assure elevational movement of the tool along the intended linear vertical travel path. Apparently, the tall supports and the elevated mounting position of the lift boom assembly result in an elevated weight center of the loader, a reduced overall stability and lifting capacity, and a marred visibility to the rear sideward direction. Another shortcoming with the lift boom assembly referred to above is that the overhang of the tool or bucket from the center of a front wheel remains great for the substantial part of its elevational movement except the initial short range of upward movement. Needless to say, it is desirable to reduce the overhang as far as possible, inasmuch as the greater the overhang, the smaller the load lifting capacity.

SUMMARY OF THE INVENTION

Accordingly, it is an object of the invention to provide a loader with such a controlled working implement travel path that can reduce the overhang of a working implement throughtout the elevational movement thereof, thus increasing the load lifting capacity and improving the overall stability of the loader.

Another object of the invention is to provide a loader whose lift booms are mounted directly to a vehicle frame at such a low position as to lower the loader weight center, increase the load lifting capacity and attain a widened rear side visibility of the loader operator, while avoiding the use of separate boom supports.

With these objects in view, there is provided a loader comprising: a frame; a pair of laterally spaced lift booms disposed at opposite lateral sides of the frame for elevational movement between lowered and raised positions, each of the lift booms having forward free end which carries a working implement and a rear proximal end articulately mounted to the frame; a pair of front control links arranged on the opposite sides of the frame, each of the front control links having a first end pivotally attached to the frame at a first pivot point and a second end pivotally connected to the rear proximal end of the respective lift boom at a first connection point; a pair of rear control links disposed at the rear of the front control links and arranged on the opposite sides of the frame, each of the rear control links having a first end pivotally attached to the frame at a second pivot point positioned rearwardly and downwardly of the first pivot point when the lift booms are in the lowered position and a second end pivotally connected to the rear proximal end of the respective lift boom at a second connection point which remains rearwardly and upwardly of the first connection point when the lift booms are in the lowered position; and actuator means for causing the respective lift boom to move along with the working implement between the lowered and raised position.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE INVENTION

Figure 1:
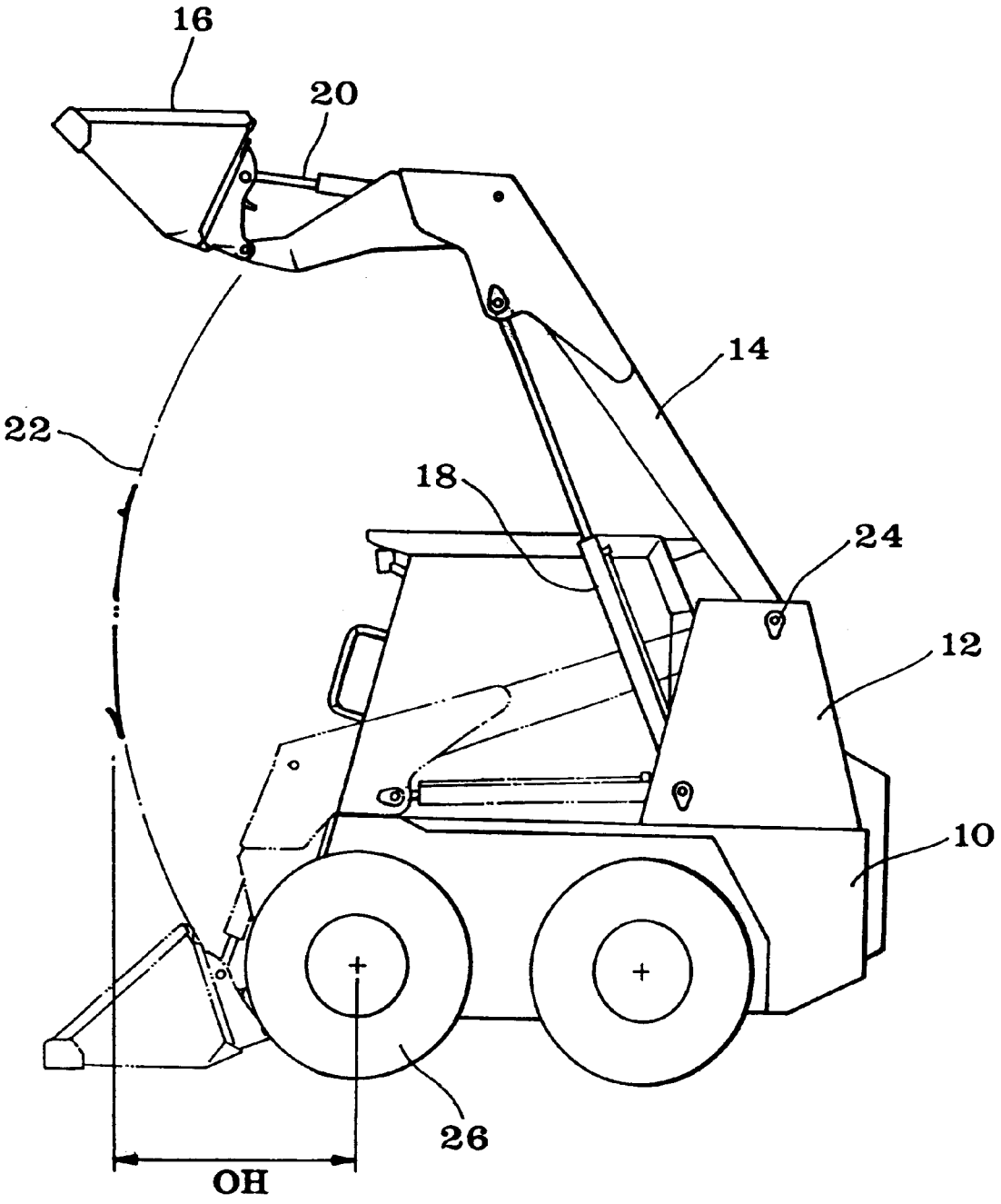
FIG. 1 (PRIOR ART)
FIG. 1 is a side elevational view of a prior art skid steer loader with the lift booms being indicated in solid and phantom lines.
Figure 2:
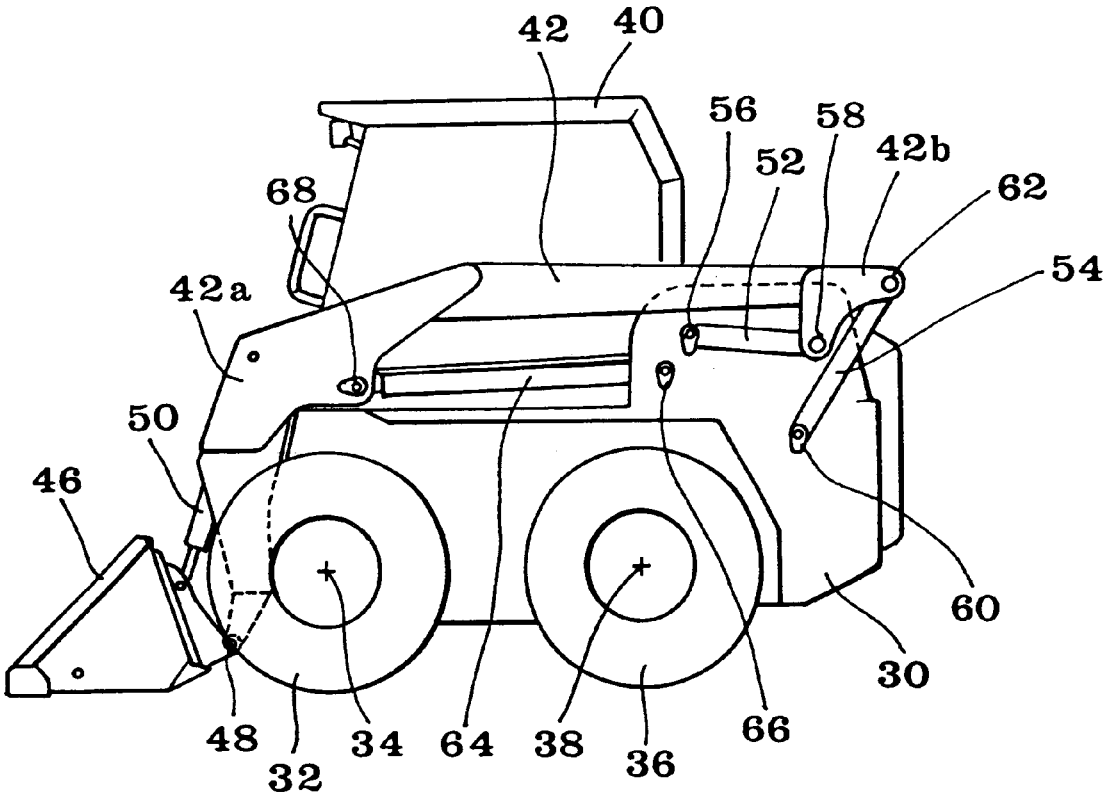
FIG. 2 is a schematic side elevational view showing a skid steer loader according to a first embodiment of the invention.
Figure 3:
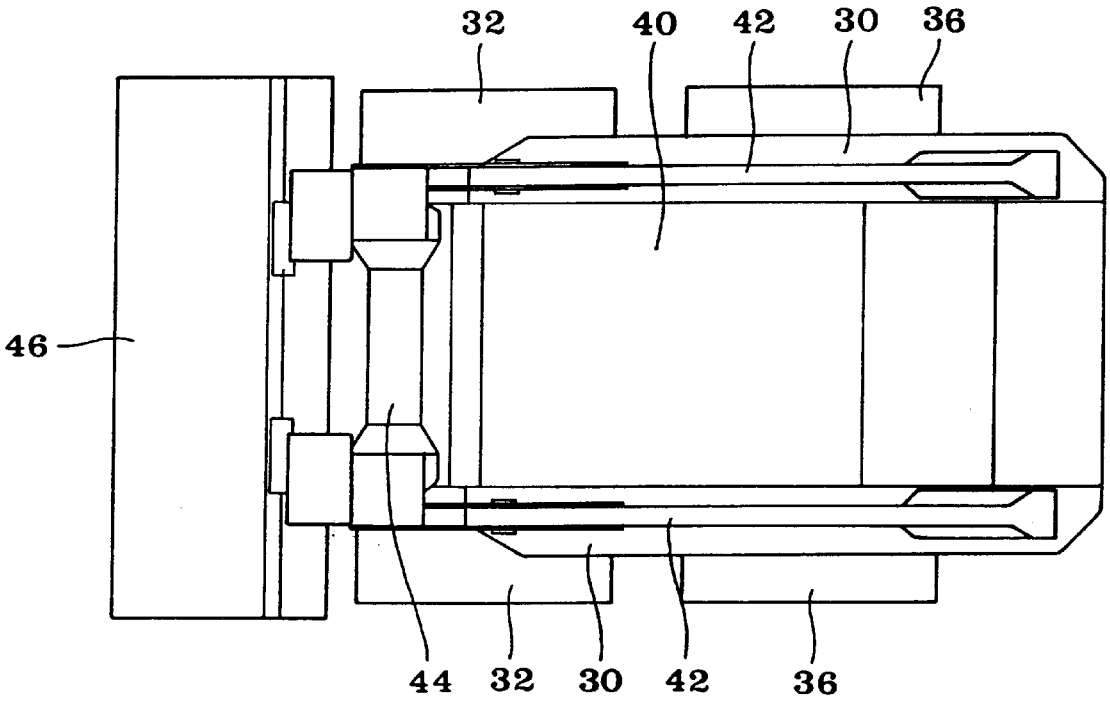
FIG. 3 is a schematic top view of the skid steer loader shown in FIG. 2, illustrating a pair of lift booms arranged on opposite sides of a frame in a symmetrical relationship with each other.
Figure 4:
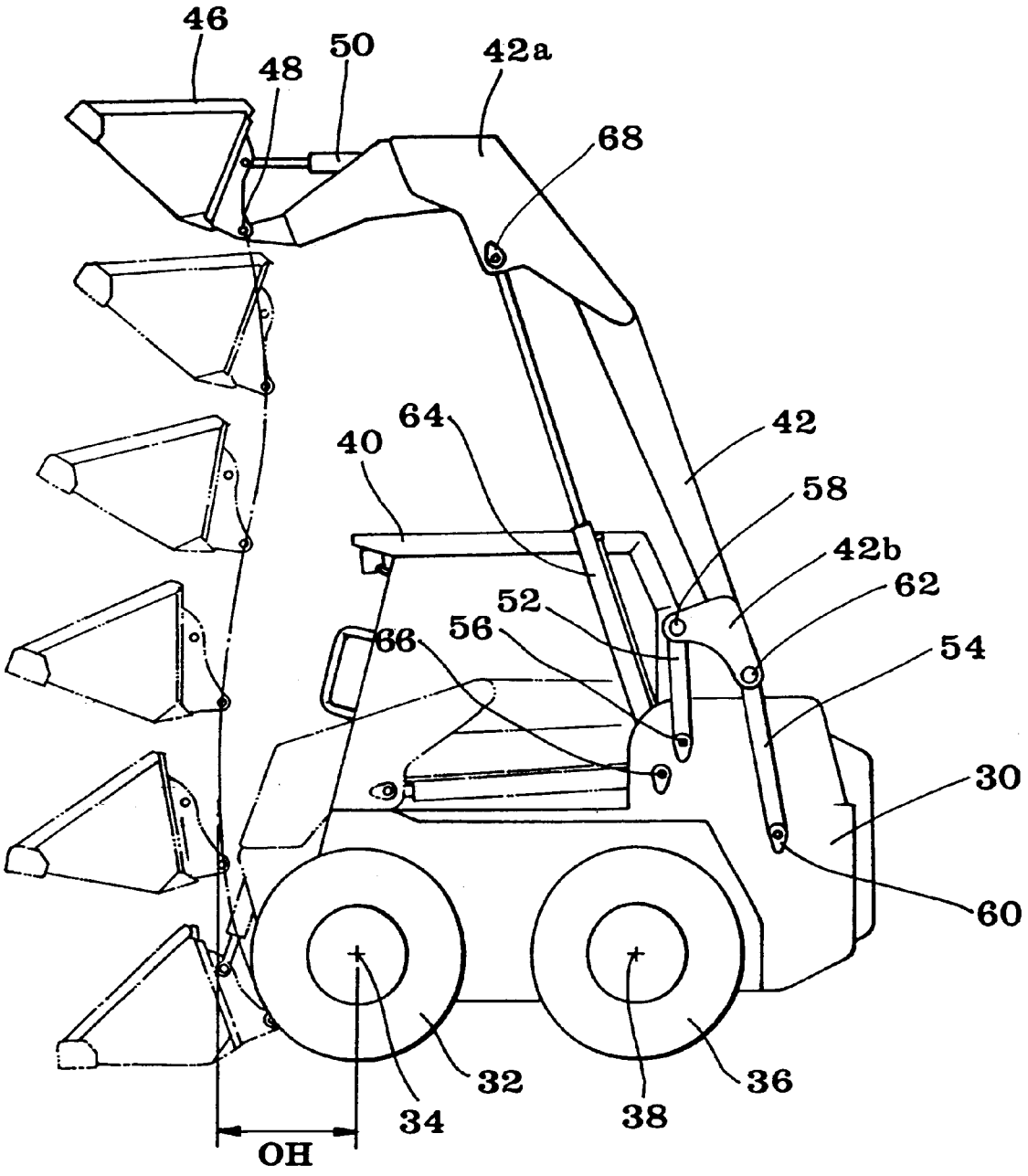
FIG. 4 is a schematic side elevational view of the skid steer loader illustrated in FIGS. 2 and 3, with the lift booms and the bucket shown in various degrees of elevation along a generally sinusoidal travel path.

Referring now to FIGS. 2 through 4, it can be appreciated that a skid steer loader according to a first embodiment of the invention is shown as having an elongated frame 30 supported on the ground by means of a pair of front wheels 32 turnable about a front axis 34 and a pair of rear wheels 36 turnable about a rear axis 38. The frame 30 is adapted to project upwardly up to about one half of the height of a canopy 40, which help improve the rear and side visibility of the loader operator and avoid unwanted interference of the canopy 40 with the frame 30 when the canopy 40 is swung back into a maintenance position in a conventionally known manner.

A pair of laterally spaced lift booms 42 are disposed at opposite lateral sides of the frame 30 for elevational movement between lowered and raised positions. As is conventional with the skid steer loader, the lift booms 42 are interconnected to each other by a cross member 44 (see FIG. 3) of suitable configuration for elevational movement in unison. The cross member 44 plays a role in adding strength to the lift booms 42. It should be understood that the lift booms 42 arranged on the opposite sides of the frame 30 are of identical structure. For this reason, only one lift boom will be described in detail hereinbelow for the sake of convenience. The respective lift boom 42 has a forward free end 42*a* which carries a working implement 46, e.g., bucket, swingably mounted thereto with a pivot pin 48. Provided between the lift boom 42 and the bucket 46 is a hydraulically operated bucket cylinder 50 which can be extended and retracted to cause swinging movement of the bucket 46 relative to the lift boom 42.

The respective lift boom 42 has a rear proximal end 42*b* articulately mounted to the rear part of the frame 30 through the use of a pair of front control links 52 and a pair of rear control links 54. The front control links 52 are arranged on opposite sides of the frame 30 at a position just beneath the respective lift boom 42 and have the identical structure with each other. The respective front control link 52 has a first end pivotally attached to the frame 30 at a first pivot point 56 and a second end pivotally connected to the rear proximal end 42*b* of the respective lift boom 42 at a first connection point 58. As best shown in FIG. 2, the front control link 52 extends in a generally horizontal direction, more exactly, rearwardly and slightly downwardly from the first pivot point 56 which has a higher elevation than the first connection point 58. Moreover, the front control link 52 is a little shorter in length than the respective rear control link 54.

In the meantime, the rear control links 54 are arranged on opposite sides of the frame 30 at a position rearward of the front control links 52 and beneath the respective lift boom 42. The rear control links 54 have the identical structure and function with each other and therefore would need no duplicate description for both. The respective rear control link 54 has a first end pivotally attached to the frame 30 at a second pivot point which is positioned rearwardly and downwardly of the first pivot point 56 when the lift booms 42 are in the lowered position and a second end pivotally connected to the rear proximal end 42*b* of the respective lift boom 42 at a second connection point 62 which remains rearwardly and upwardly of the first connection point 58 when the lift booms 42 are in the lowered position. As clearly illustrated in FIG. 2, the respective rear control link 54 extends rearwardly and upwardly from the second pivot 60. It should be noted that the lift boom 42, the front control link 52 and the rear control link 54 arranged on the respective side of the frame 30 lie in a common vertical plane.

In order to cause elevational movement of the lift booms 42 and the bucket 46 carried thereby, a suitable actuator, e.g., a pair of double acting hydraulic boom cylinders 64 are arranged on opposite sides of the frame 30 at a position beneath the lift booms 42. Each of the boom cylinders 64 has a first housing end pivotally attached to the rear part of the frame 30 at a third pivot point 66 of lower elevation than the first pivot point 56 and a second rod end pivotally connected to the forward end 42*a* of the respective lift boom 42 at a third connection point 68 which has a lower elevation than the third pivot point 66 thereof. The extension length or stroke of the respective boom cylinder 64 is such that the respective lift boom 42 and the bucket 46 can be brought into the raised position when the boom cylinder 64 is fully extended.

Operation of the loader according to the first embodiment of the invention will be set forth in detail with reference to FIGS. 2 and 4.

Initially, the respective lift boom 42 and the bucket 46 carried thereby assume the lowered position as indicated in phantom lines in FIG. 4. At this moment, the front control link 52 extends rearwardly and slightly downwardly from the first pivot point 56, while the rear control link 54 runs upwardly and rearwardly from the second pivot point 60, as best illustrated in FIG. 2.

If hydraulic pressure is supplied to the boom cylinder 64 from a suitable pressure source(not shown), the boom cylinder 64 begins to extend whereby the respective lift boom 42 and the bucket 46 is subject to elevational movement out of the lowered position. As the lift boom 42 is raised up by the boom cylinder 64, the front control link 52 and the rear control link 54 are caused to turn counterclockwise about the first pivot point 56 and the second pivot point 60, respectively.

Continued extension of the boom cylinder 64 will cause the bucket 46 to move along a generally sinusoidal travel path which has forward convexity at its lower half part and backward convexity at its upper half part. Since the forward convexity is not so great, the overhang OH measured from the axis 34 of the front wheel 32 to the pivot pin 48 of the bucket 46 can be maintained small throughout the entire process of elevational movement of the bucket 46. This provides significant improvement in the stability, load lifting capacity and maneuverability of the loader.

When the bucket 46 reaches the raised position as indicated in solid lines in FIG. 4, the front control link 52 and the rear control link 54 extend upwardly and forwardly. If the bucket 46 is raised up to an intended elevation in this manner, the bucket cylinder 50 is operated to turn the bucket 46 counterclockwise about the pivot pin 48, thereby dumping the material held by the bucket 46 into a truck for instance. At the end of dumping operation, the boom cylinder 64 is gradually retracted to allow the bucket 46 to be lowered along the generally sinusoidal travel path in the reverse direction.

Figure 5:
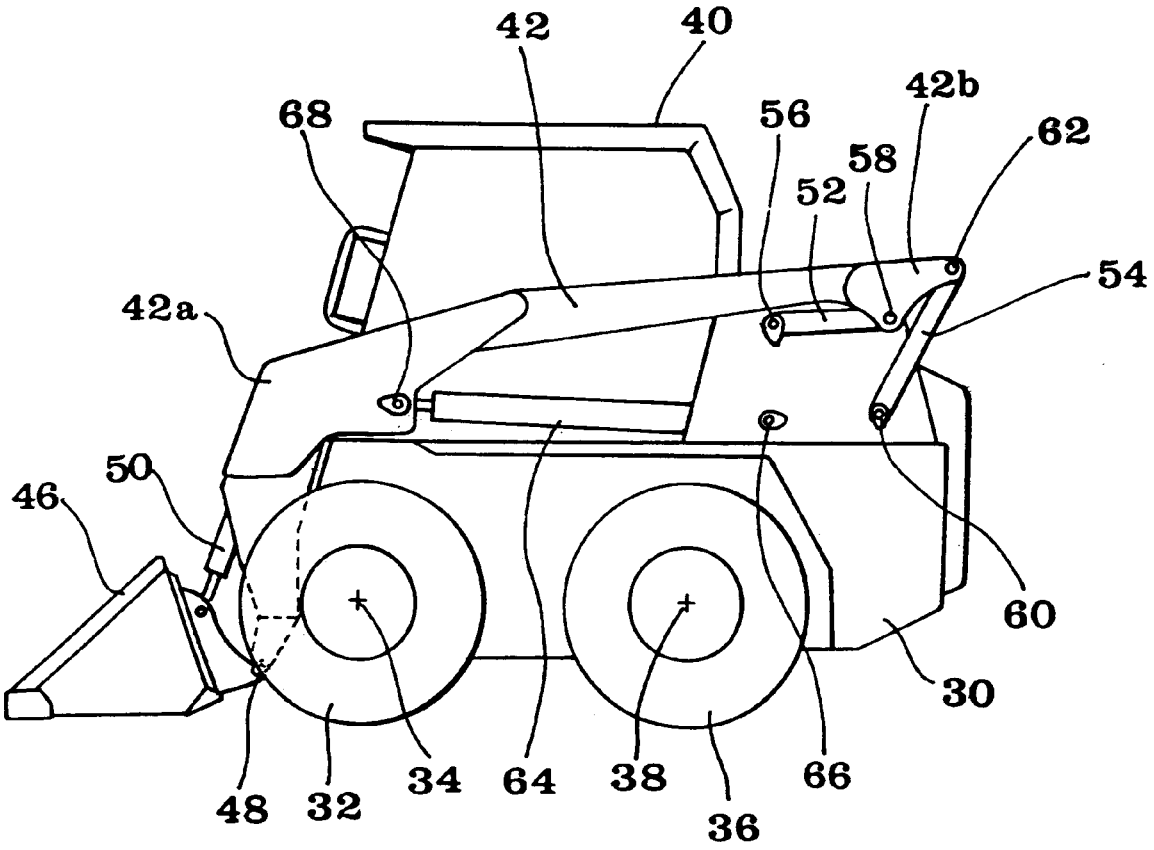
FIG. 5 is a schematic side elevational view showing a skid steer loader according to a second embodiment of the invention wherein each front control link extends rearwardly and slightly upwardly, with each boom cylinder extending frontwardly and slightly upwardly.
Figure 6:
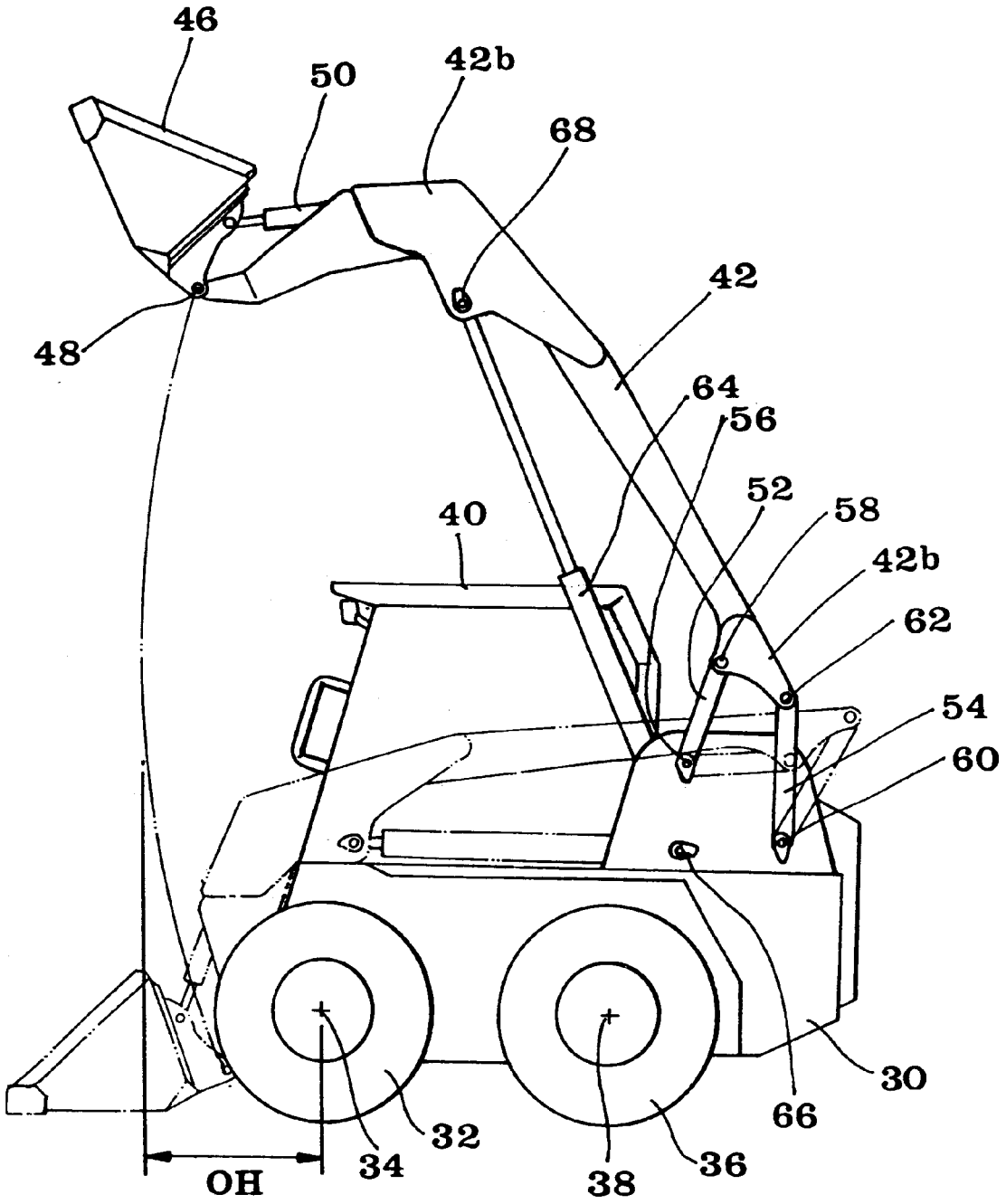
FIG. 6 is a schematic side elevational view of the skid steer loader illustrated in FIG. 5, showing the lift booms and the bucket in raised and lowered positions.

Referring to FIGS. 5 and 6, there is illustrated a skid steer loader in accordance with the second embodiment of the invention wherein like parts or components are designated with the same reference numerals as used in the aforementioned first embodiment. In the second embodiment of the invention, the first pivot point 56 of the respective front control link 52 has a lower elevation than the first connection point 58 thereof and the third pivot point 66 of the respective boom cylinder 64 has a lower elevation than the third connection point 68 thereof, when the lift booms 42 are in the lowered position. By virtue of this modification, the bucket 46 can elevationally move along a gentle arcuate curve of forward convexity with increased radius of curvature. Based on this embodiment, the overhang OH of the bucket 46 becomes a little greater than the one in the first embodiment but the reaction force exerting on the lift booms 42 is reduced with a result that the bucket 46 can be moved faster than in the preceding embodiment.

Figure 7:
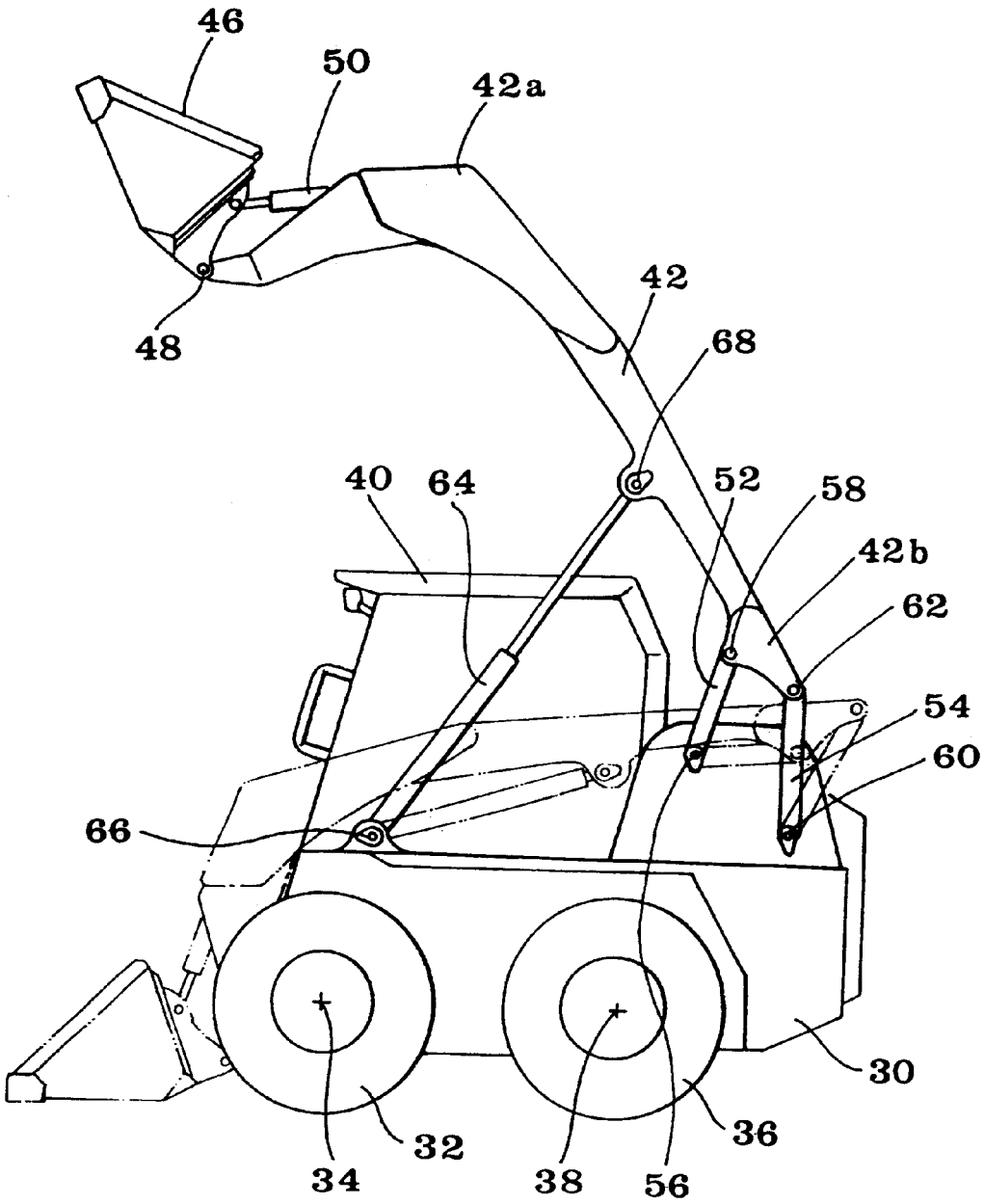
FIG. 7 is a schematic side elevational view indicating a skid steer loader according to a third embodiment of the invention wherein a first end of the respective boom cylinder is pivotally attached to a forward part of a frame, with its second end pivotally connected to the intermediate part of the respective lift boom.

A third embodiment of the invention is shown in FIG. 7 wherein like parts or components of the loader are designated with the same reference numerals as used in the preceding embodiments. In the third embodiment, each of the boom cylinders 64 arranged on the opposite sides of the frame 30 has a first end pivotally attached to the front part of the frame 30 at a third pivot point 66 and a second end pivotally connected at a third connection point 68 to the respective lift boom 42 intermediate the forward and rear ends thereof. This makes it possible to shorten the length of the boom cylinders 64, although some increase in the effective diameter thereof is unavoidable.

While the invention has been described with reference to a preferred embodiment, it should be apparent to those skilled in the art that many changes and modifications may be made without departing from the scope of the invention as defined in the claims.

What is claimed is:

1. A loader comprising:

a frame;

a pair of laterally spaced lift booms disposed at opposite lateral sides of the frame for elevational movement between lowered and raised positions, each of the lift booms having a forward free end which carries a working implement and a rear proximal end articulately mounted to the frame;

a pair of front control links arranged on the opposite sides of the frame, each of the front control links having a first end pivotally attached to a rear part of the frame at a first pivot point and a second end pivotally connected to the rear proximal end of the respective lift boom at a first connection point;

a pair of rear control links disposed rearward of the front control links and arranged on the opposite sides of the frame, each of the rear control links having a first end pivotally attached to the frame at a second pivot point positioned rearwardly and downwardly of the first pivot point when the lift booms are in the lowered position and a second end pivotally connected to the rear proximal end of the respective lift boom at a second connection point positioned rearwardly and upwardly of the first connection point when the lift booms are in the lowered position; and actuator means for causing the respective lift boom to move along with the working implement between the lowered and raised positions.

2. The loader as recited in claim 1, wherein each of the front control link is shorter in length than the respective rear control link.

3. The loader as recited in claim 1, wherein each of the front control links extends rearwardly from the first pivot point in a generally horizontal direction, and each of the rear control links extends rearwardly upwardly from the second pivot point, when the lift booms are in the lowered position.

4. The loader as recited in claim 1, wherein the actuator means includes a pair of hydraulic cylinders arranged on the opposite sides of the frame, each of the hydraulic cylinders having a first end pivotally attached to a rear part of the frame at a third pivot point and a second end pivotally connected to the forward end of the respective lift boom at a third connection point.

5. The loader as recited in claim 4, wherein the first pivot point of the respective front control link has a higher elevation than the first connection point thereof and the third pivot point of the respective hydraulic cylinder has a higher elevation than the third connection point thereof, when the lift booms are in the lowered position.

6. The loader as recited in claim 4, wherein the first pivot point of the respective front control link has a lower elevation than the first connection point thereof, and the third pivot point of the respective hydraulic cylinder has a lower elevation than the third connection point thereof, when the lift booms are in the lowered position.

7. The loader as recited in claim 1, wherein the actuator means includes a pair of hydraulic cylinders arranged on the opposite sides of the frame, each of the hydraulic cylinders having a first end pivotally attached to a front part of the frame at a third pivot point and a second end pivotally connected to the respective lift boom intermediate the forward and rear ends thereof.

8. The loader as recited in claim 1, wherein the respective lift boom, the respective front control link and the respective rear control link lie in a common vertical plane.

9. The loader as recited in claim 1, wherein the working implement comprises a bucket swingably mounted to the forward free ends of the lift booms, and further comprising a bucket cylinder provided between the lift booms and the bucket for causing swinging movement of the bucket relative to the lift booms.

10. A lift boom assembly for use in a loader having a frame, comprising:

a pair of laterally spaced lift booms disposed at opposite lateral sides of the frame for elevational movement between lowered and raised positions, each of the lift booms having a forward free end which carries a working implement and a rear proximal end articulately mounted to the frame;

a pair of front control links arranged on the opposite sides of the frame, each of the front control links having a first end pivotally attached to a rear part of the frame at a first pivot point and a second end pivotally connected to the rear proximal end of the respective lift boom at a first connection point;

a pair of rear control links disposed rearward of the front control links and arranged on the opposite sides of the frame, each of the rear control links having a first end pivotally attached to the frame at a second pivot point positioned rearwardly and downwardly of the first pivot point when the lift booms are in the lowered position and a second end pivotally connected to the rear proximal end of the respective lift boom at a second connection point positioned rearwardly and upwardly of the first connection point when the lift booms are in the lowered position; and actuator means for causing the respective lift boom to move along with the working implement between the lowered and raised positions.

11. The lift boom assembly as recited in claim 10, wherein each of the front control link is shorter in length than the respective rear control link.

12. The lift boom assembly as recited in claim 10, wherein each of the front control links extends rearwardly from the first pivot point in a generally horizontal direction, and each of the rear control links extends rearwardly upwardly from the second pivot point, when the lift booms are in the lowered position.

13. The lift boom assembly as recited in claim 10, wherein the actuator means includes a pair of hydraulic cylinders arranged on the opposite sides of the frame, each of the hydraulic cylinders having a first end pivotally attached to a rear part of the frame at a third pivot point and a second end pivotally connected to the forward end of the respective lift boom at a third connection point.

* * * * *